US005741013A

United States Patent [19]

Hamano et al.

[11] Patent Number: 5,741,013

[45] Date of Patent: Apr. 21, 1998

[54] PRIZE CATCHING GAME MACHINE

[75] Inventors: Takashi Hamano, Kawasaki; Yuichiro Sagawa, Yamato, both of Japan

[73] Assignee: Konami Co., Ltd., Hyogo-ken, Japan

[21] Appl. No.: 703,291

[22] Filed: Aug. 26, 1996

[30] Foreign Application Priority Data

Aug. 28, 1995 [JP] Japan ..... 7-240469

[51] Int. Cl.[6] ..... A63F 9/00

[52] U.S. Cl. ..... 273/447

[58] Field of Search ..... 273/447, 448

[56] References Cited

U.S. PATENT DOCUMENTS 5,368,310 11/1994 Ogata et al. ..... 270/448

FOREIGN PATENT DOCUMENTS 345751 10/1987 Japan .

4-60279 5/1992 Japan .

7-323144 12/1995 Japan .

2223179 4/1990 United Kingdom .

9208530 5/1992 WIPO .

*Primary Examiner*—William E. Stoll

*Attorney, Agent, or Firm*—Jordan and Hamburg

[57] ABSTRACT

A prize catching game machine having a table; a prize catcher for catching a prize carried on the table and transferring the prize which has been caught to a predetermined position and releasing the prize at the position; and a prize receiver movable between a first position and a second position for changing a receiving area to receive the released prize. The relative predetermined position at which the prize is released is set such that the position from the top view is in the receiving area of the prize receiver at least at one point between the first and second positions.

9 Claims, 7 Drawing Sheets

PRIZE CATCHING GAME MACHINE

BACKGROUND OF THE INVENTION AND RELATED ART STATEMENT

The present invention relates to a prize catching game machine on which each player attempts to acquire prizes such as packets of confectionery, stuffed dolls or toys, for example, which are displayed on a prize table by using his or her skill at controlling the machine's actions.

A prize catching game machine of this kind is disclosed in Japanese Examined Utility Model Publication No. 3-45751, for example, in which a player scoops up a prize displayed on a rotating prize table by means of a shovel and drops the prize at a prize dropping position. The prize is then pushed out to a prize delivery port due to relative movement of a fixed table and a transfer table, both of which are provided beneath the prize dropping position, so that the player can capture the prize.

In the above-mentioned prize catching game machine of the prior art, each player is required to successfully perform two steps of operation in order to take out a desired prize. Specifically, a player should scoop up a prize at first and, then, drop the prize at the specified location. Although this prize catching game machine is more complex in operation and more interesting to play at compared to conventional crane mechanism type prize catching game machines, it has such a problem that the prize dropped at the prize dropping position may not be pushed out properly down to the prize delivery port on occasion depending on the relative positional relationship between the fixed table and the transfer table. Should this occur, the player can not acquire the prize which has successfully been scooped with the shovel and placed onto either one of the fixed table or the transfer table, and this can make the machine less attractive.

SUMMARY OF THE INVENTION

The present invention is directed toward the solution of the problem of the prior art. It is, therefore, an object of the invention to provide a prize catching game machine which, involving the aforementioned two-step sequence of scooping a desired prize and then dropping it at a specified position, enables players to play more interesting games compared to the prize catching game machines of the prior art.

The invention can be implemented in a prize catching game machine on which a player attempts to acquire any of prizes displayed on a prize table by catching a prize therefrom and taking it to the outside of the prize catching game machine through a prize delivery port.

In order to achieve the aforementioned object, a prize catching game machine according to this invention comprises a table; a prize catcher for catching a prize carried on the table and transferring the prize which has been caught to a predetermined position and releasing the prize at the position; and a prize receiver movable between a first position and a second position for changing a receiving area to receive the released prize and from the top view the predetermined position of the prize is enclosed in the receiving area of the prize receiver at least at one point between the first and second positions.

The prize catcher is used for catching the prize from the table and moving it from the table to the predetermined position. It is therefore preferable that the prize catcher include a scooping, hooking or sucking mechanism such as a shovel, claws or a vacuum head and a transport mechanism such as an arm or a crane for moving the prize held by the prize catcher. The type of the prize catcher is depending upon shapes and weights of individual prize items. Just to mention a couple of examples, either a gripping or sucking mechanism may be used if relatively large-sized prizes such as stuffed dolls or toys are employed while a scooping mechanism would be suitable for small-sized prizes such as packets of confectionery to provide effective operation and interesting games.

The prize receiver may include, for example, a plate member driven by a motor via a crank mechanism which converts a rotary motion into a linear motion to cause the plate member to reciprocate between the first position and the second position as mentioned above. Alternatively, the prize receiver may be a plate member directly driven by a linear driving mechanism such as a linear motor. The moving speed of the prize receiver need not be constant all the way along its reciprocating strokes between the first position and the second position. As an example, the prize receiver may be controlled such that its moving speed becomes higher near the second position where the prize receiver realizes its widest receiving area. Should this arrangement be made, it would become difficult for the player to release (or drop) the prize with correct timing. This will create increased excitement in playing on the prize catching game machine.

The prize catching game machine thus constructed allows the player to pick up a prize and release it at the predetermined position. If the prize catcher at the predetermined position from the top view (or in the plan view) is in the prize receiving area of the prize receiver when the prize is released, the prize will likely fall onto the prize receiver. Then if the prize fall onto the prize receiver and remains on the prize receiver despite a collision between the prize and the prize receiver, the prize would be acquired by the player. Thus there would be no disappointment for the player once he or she successfully carried out the two step operations. It should be noted that the prize released at the right timing from the prize catcher onto the prize receiver is not necessarily remaining on the receiver because the prize receiver moves between the first and second positions thus it is not easy to predict the direction of the reaction force acting on the prize. Therefore, the successfully carrying out the second step, releasing the prize, in this context is meant that the prize released from the prize catcher stays on the prize receiver.

Thus, this invention makes prize capturing games more enjoyable compared to the aforementioned conventional arrangements.

According to another aspect of this invention, the prize receiver may be constructed in the shape of a plate and the prize receiving area is defined as an area of the plate which is capable of receiving the released prize.

With this construction, the prize captured by the prize catcher has lesser chance of remaining on the prize receiver though the prize successfully fell onto the receiver compared to the prize receiver constructed in the shape of box with an upward opening. Thus it enhances a degree of uncertainty of acquiring the prize. As a result, it makes the game more enjoyable.

According to another aspect of the invention, the receiving area increases as the prize catcher moves the first position to the second position. The invention thus constructed gives a greater chance of acquiring the prize when the prize is released just around the time the prize receiver is at the second position. Since the motion of the prize receiver is not arbitrary, thus the player can improve the chance of winning by getting used to the motion of the receiver. As a result, the player is encouraged to play until he or she knows a correct timing of releasing the prize according to the movement of the prize receiver.

Another aspect of the invention, the game machine further comprises a prize discharging device for transmitting the prize on the prize receiver at the first position to a prize delivery port for enabling an access to the prize from outside of the game machine.

With this construction, the prize once successfully placed on the prize receiver is delivered to the prize delivery port through which the player can acquire the prize.

The prize discharging device may include, for example, a push arm for positively forcing the prize on the prize receiver at the first position toward the prize delivery port. Alternatively, there may be provided a fixed member in the vicinity of the prize receiver so that the fixed member shoves away the prize, causing it to be guided toward the prize delivery port, when the moving prize receiver brings the prize into contact with the fixed member.

Still another aspect of this invention, a game machine further comprise a time indicator for allowing a player to set the timings for the prize catcher to initiate a catching operation and the prize catcher to initiate a releasing operation.

The time indicator (or timing device) includes, for instance, a push-button which may be of a simple push-and-release type for activating the prize catcher, or of a type which causes the prize catcher to perform the prize catching and releasing operations while the push-button is held down. Where in the case that the prize catcher includes a shovel and an arm as mentioned in the above, the time indicator (or timing device) may include separate facilities for activating the shovel and the arm independently of each other.

With this arrangement, the player can control the timing of the prize catching and releasing (dropping) operations performed by the prize catcher. This would serve to make the prize catching games even more enjoyable.

According to still another aspect of this invention, the prize catcher may include a prize catching member which has a larger width than that of the prize receiver.

In this construction, the prize catching member could catch a relatively large number of prize items. A resultant visual effect gives the player a sense of satisfaction in playing prize capturing games at the first stage. However, when the player succeeds in catching a large number of prize items, there remains other condition to be met in order for the player to actually obtain the prize items. As mentioned in the above the player then has to carefully select the timing of releasing the prize items ( a second stage ). As a result, this structure with a larger size prize catcher allows the player to catch relatively large numbers of prize items to give him/her the feeling of success at the first stage of this game. This will serve to provide exciting prize capturing games and make the player enthusiastic about acquiring more prizes.

According to yet another aspect of this invention, the prize catcher includes an arm which is rotatable around a horizontal axis between a third position and a fourth position and a catching plate which is pivotally mounted at one end of the arm and, the prize receiver includes a receiving plate which is driven to move between the first position and the second position in a horizontal plane, wherein a relative position of the prize catcher and the prize receiver is set such that the prize captured by the prize catcher at the fourth position will fall onto the prize receiver by rotating the catching plate with respect to the arm when the receiving plate is at the second position.

According to still another aspect of the invention, a direction of movement of the prize catcher in a plan view is set substantially parallel to a direction of movement of the prize receiver in the plan view.

With this arrangement, it can be constructed that the moving range of the prize catcher and the moving range of the prize receiver in the plan view overlap considerably. As a result, the size of the prize catching game machine can be maintained within a relatively smaller range as compared to that of the conventional prize catching game machine.

Furthermore, the prize catcher may be constructed with an arm which is rotatable with respect to a horizontal axis extending through one end thereof and a shovel which is rotatably mounted on the other end of the arm.

These and other objects, features and advantages of the invention will become more apparent upon a reading of the following detailed description of the preferred embodiment with reference to the appended drawings.

DETAILED DESCRIPTION OF THE PREFERRED EMBODIMENT OF THE INVENTION

Figure 1:
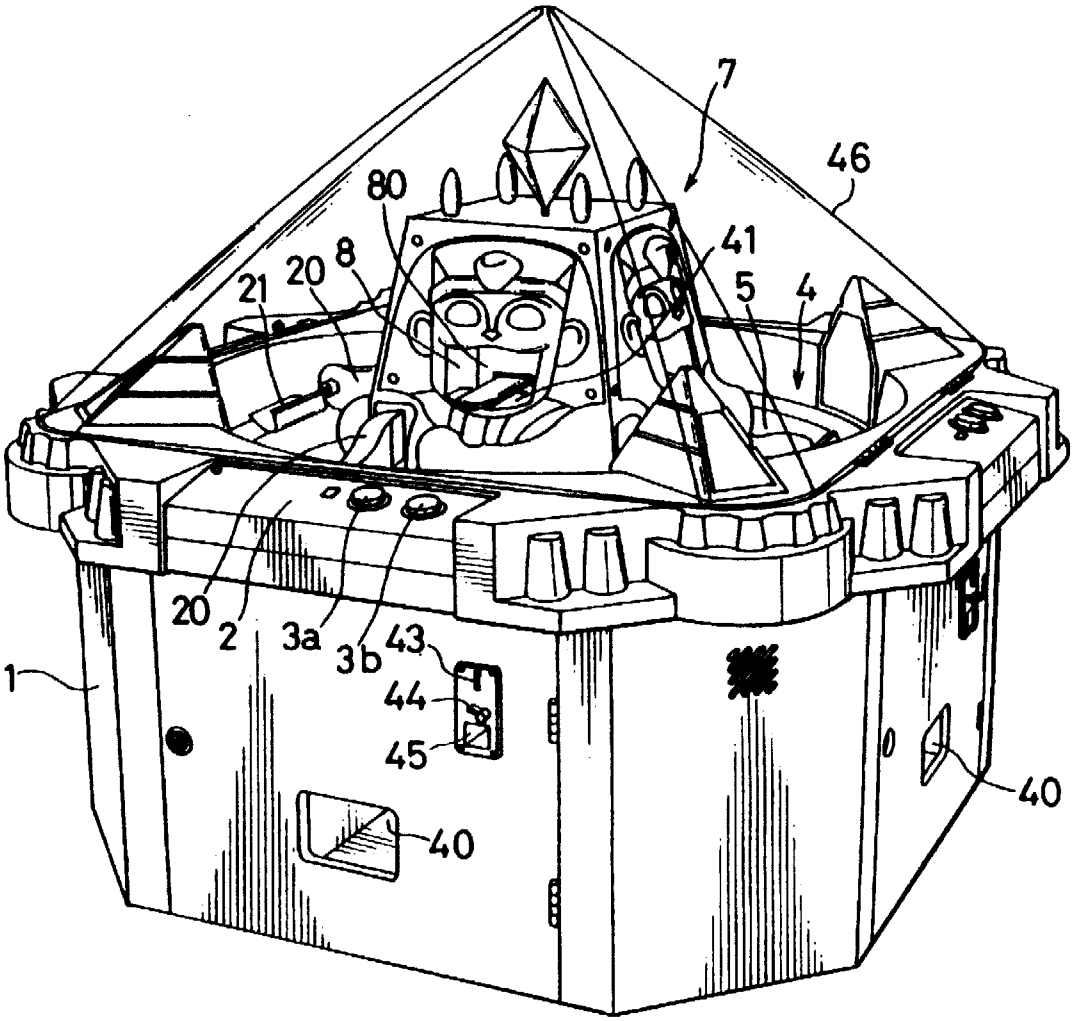
FIG. 1 is a perspective view of a prize catching game machine according to a preferred embodiment of the invention.
Figure 2:
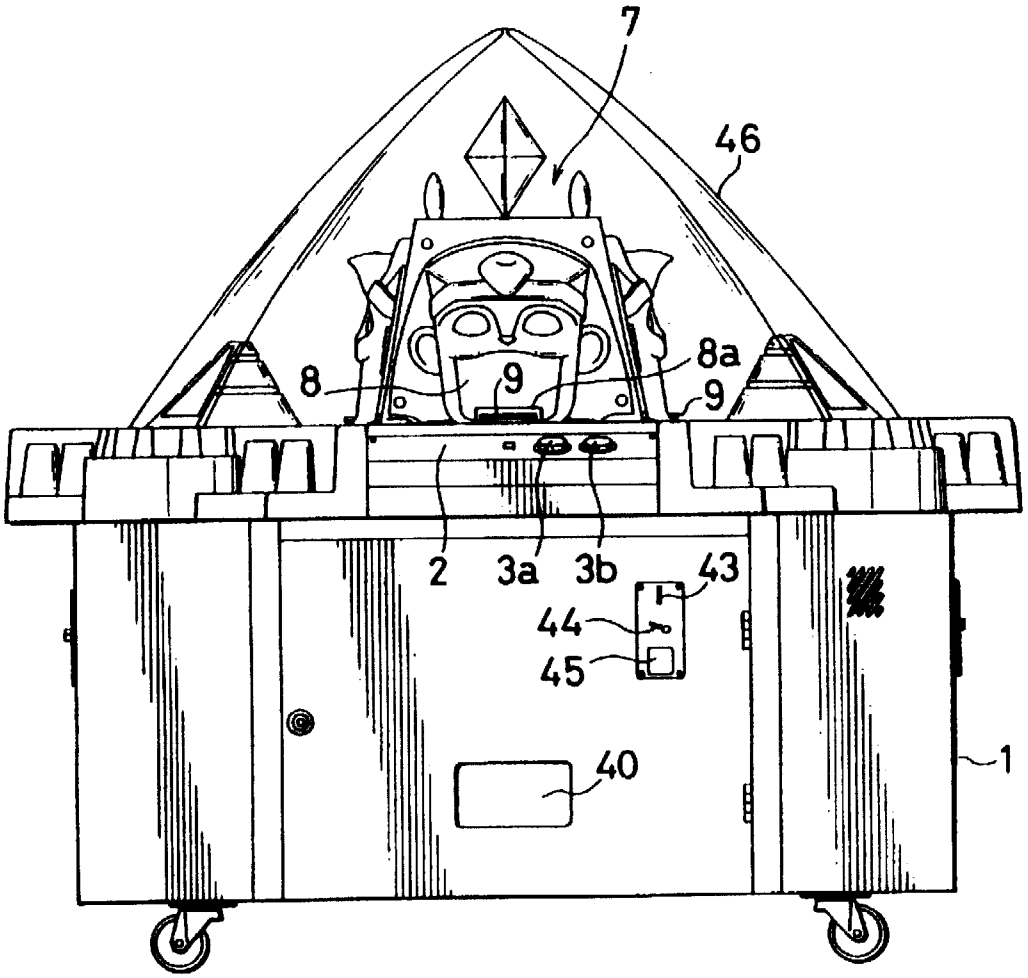
FIG. 2 is a front view of the prize catching game machine.
Figure 3:
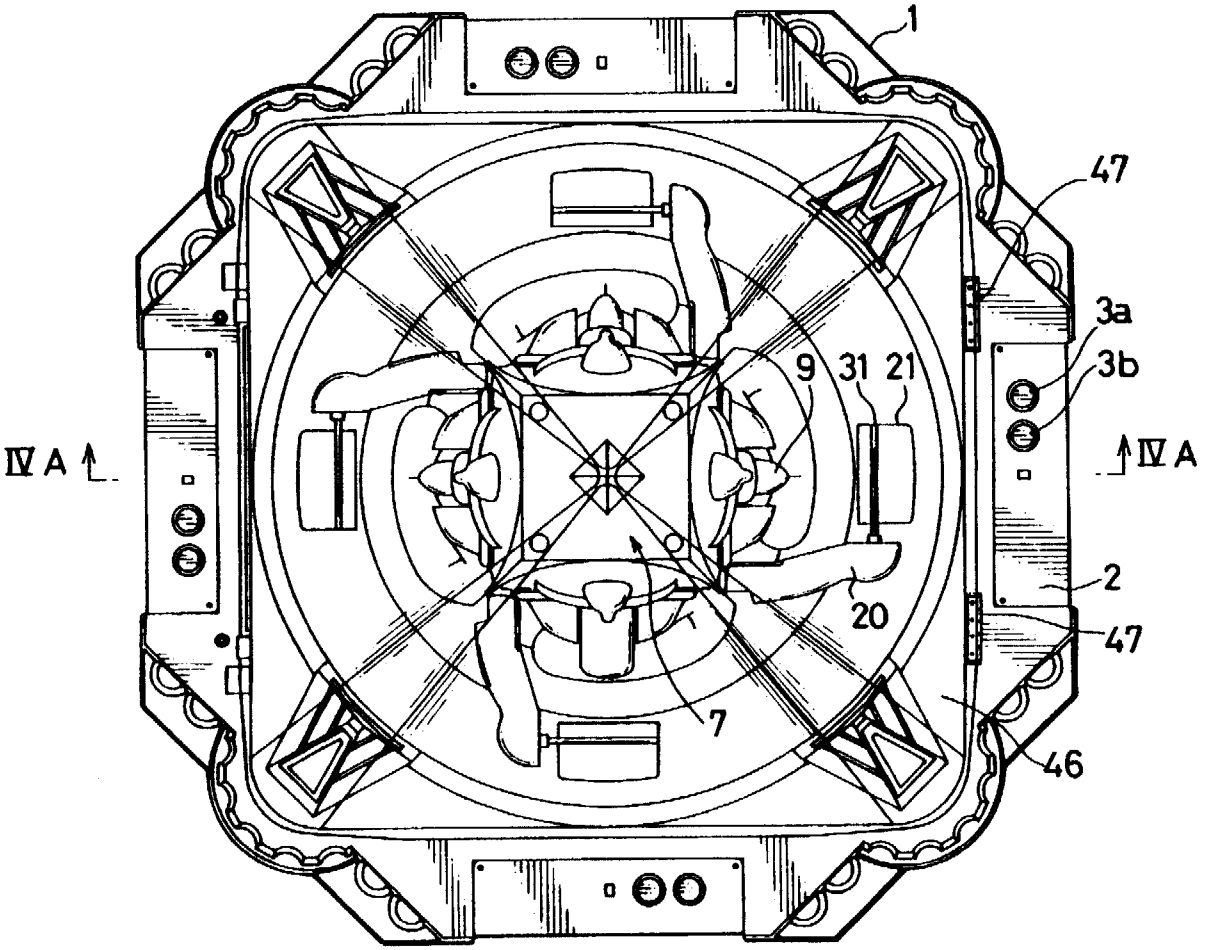
FIG. 3 is a plan view of the prize catching game machine.
Figure 4A:
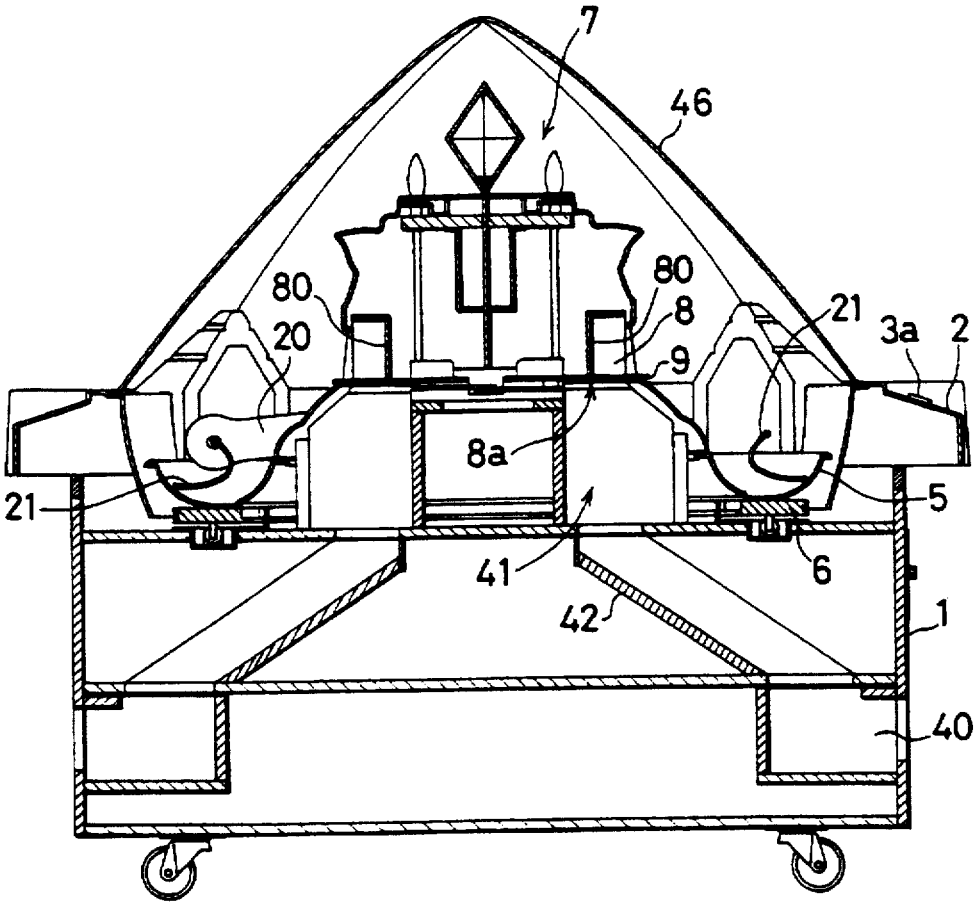
FIG. 4A is a cross-sectional view taken in the direction of arrows along line IVA—IVA shown in FIG. 3.

The invention is now described with reference to a preferred embodiment thereof, which is illustrated in the accompanying drawings. FIG. 1 is a perspective view of a prize catching game machine according to the embodiment of the invention; FIG. 2 is a front view of the prize catching game machine; FIG. 3 is a plan view of the prize catching game machine; and FIG. 4A is a cross-sectional view taken in the direction of arrows along lines IVA—IVA shown in FIG. 3.

In these drawings, designated by the numeral 1 is a main body of the prize catching game machine having a generally octagonal shape in top view, which would be formed by cutting off corners of a square, as shown in FIG. 3. The prize catching game machine of this embodiment allows up to four players to play at the same time, competing against each other in a prize capturing game. Designated by the numeral 2 is one of four operating consoles (control panels) which are provided at upper positions on four sides of the main body 1 of the prize catching game machine. Each operating console 2 is provided with buttons 3*a* and 3*b* which are used by each player to control individual actions of the prize catching game machine, as will be described in detail later in this Specification.

There is formed a circular recessed portion 4 in the middle of a top surface of the main body 1. This recessed portion 4 is used as a display area on which prizes are displayed, scooped up and dropped. As shown in FIGS. 3 and 4, there is provided an annular vessel 5 (also referred to as a table) having approximately a semicircular cross section on the display area 4. The vessel 5 is made rotatable about the center of the display area 4. More particularly, the vessel 5 is mounted on top of a ring-shaped support plate 6, which is placed on a bottom plate of the display area 4 with a rolling mechanism such as rollers or wheels mounted in between so that the support plate 6 carrying the vessel 5 can freely rotate on the top of the display area 4 about its center. A belt (not shown) is wound around the outer periphery of the support plate 6 and the belt is turned by a turning mechanism (not shown) such as a motor, for example, so that the vessel 5 rotates together with the support plate 6 on the display area 4. The vessel 5 holds various prizes (not shown) such as packets of confectionery, stuffed dolls or toys, for example.

Figure 4B:
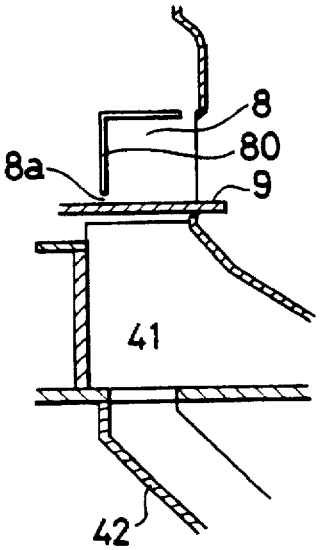
FIG. 4B is an enlarged sectional view in part showing a portion surrounding a tongue shaped plate element of FIG. 4A.

Designated by the numeral 7 is a main mechanical block mounted in the upright position in the middle of the display area 4, and designated by the numeral 8 is one of four holes in side walks of the main mechanical block 7 opening in the directions of the individual operating consoles 2. Designated by the numeral 9 are tongue-shaped plate elements (also referred to as a prize receiver) provided in the individual holes 8. These tongue-shaped plate elements 9 are mounted in such a way that they can come out and retract through slits 8*a* formed in the back of the individual holes 8 as shown in FIGS. 4A and 4B.

Figure 7:
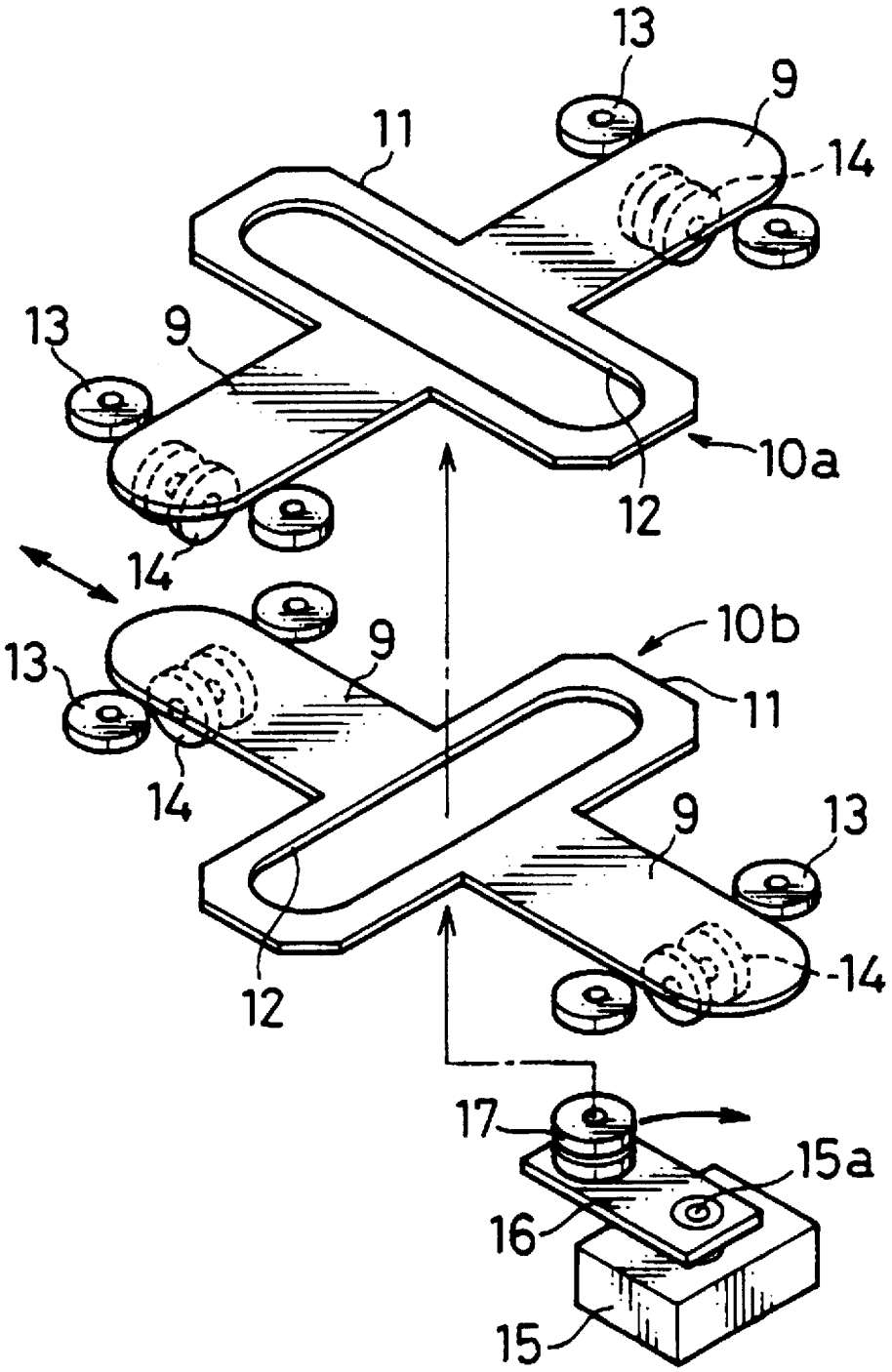
FIG. 7 is an exploded view generally illustrating the construction of tongue-shaped plate elements assembled into a main mechanical block.

The construction of the tongue-shaped plate elements 9 is now described with reference to FIG. 7, in which designated by the numerals 10*a* and 10*b* are a pair of sustaining plates formed in a common shape. Each sustaining plate 10*a*, 10*b* has a generally rectangular-shaped central retaining portion 11 from which a pair of tongue-shaped plate elements 9 extend on both sides. At a central part of the central retaining portion 11 of each sustaining plate 10*a*, 10*b*, there is formed a slot 12 extending in a longitudinal direction of the central retaining portion 11, as shown in FIG. 7. Supported in a horizontal position, each sustaining plate 10*a*, 10*b* is made slidable back and forth in a longitudinal direction of its tongue-shaped plate elements 9 by means of rollers 13 and 14 (not shown in FIGS. 1 to 4). The two sustaining plates 10*a* and 10*b* are mounted in the main mechanical block 7 in such a way that their longitudinal axes intersect at right angles to each other.

Designated by the numeral 15 is a motor, designated by the numeral 16 is a crank of which one end is connected to a drive shaft 15*a* of the motor 15, and designated by the numeral 17 is a roller mounted rotatably at the other end of the crank 16. The roller 17 is fitted in the slots 12 of the two sustaining plates 10*a* and 10*b*. Therefore, when the motor 15 rotates causing the crank 16 to turn around, the roller 17 moves reciprocally in the slots 12. This movement of the roller 17 causes the sustaining plates 10*a* and 10*b* to move back and forth in the longitudinal directions of the individual tongue-shaped plate elements 9. Consequently, each tongue-shaped plate element 9 reciprocates in a horizontal position between an internal position of the main mechanical block 7 and its forward position through the slit 8*a* of the relevant hole 8, in which the stroke of the reciprocating motion of each tongue-shaped plate element 9 is determined by the length of the slog 12 of each sustaining plate 10*a*, 10*b*.

Although not specifically depicted in FIG. 7, the two sustaining plates 10*a* and 10*b* are so arranged that the roller 17 is positioned at approximately the centers of the slots 12 of the sustaining plates 10*a* and 10*b* at some point of time in this embodiment. This means that the individual sustaining plates 10*a* and 10*b* reciprocate with a mutual phase difference of 90 degrees. As a result, only one of the four tongue-shaped plate element 9 protrudes from the relevant hole 8 at any given point in time.

Referring again to FIGS. 1 to 4, designated by the numeral 20 is one of four arms provided for the individual operating consoles 2 (as well as for the individual holes 8 and tongue-shaped plate elements 9). Each of these arms 20 is swingably attached to the main mechanical block 7 at one end. Designated by the numeral 21 is a shovel rotatably attached to a free end of each arm 20. As shown in FIGS. 4A and 4B, each shovel 21 is formed by bending a plate member into a hook-shaped cross section. Supported by the main mechanical block 7, each arm 20 is made swingable by means of a turning mechanism (not shown) and each shovel 21 is made rotatable relative to its arm 20 by means of another turning mechanism (not shown). The shovel 21 and the arm 20 together constitute a prize catcher.

A pivot about which each arm 20 carrying a shovel 21 at its free end is swung is so arranged that the shovel 21 can be moved approximately between a position immediately above the vessel 5 and a position a little above the relevant tongue-shaped plate element 9. The direction of swing of each shovel 21 caused by its arm 20 approximately coincides with the direction of the reciprocating motion of the relevant tongue-shaped plate element 9.

Figure 5:
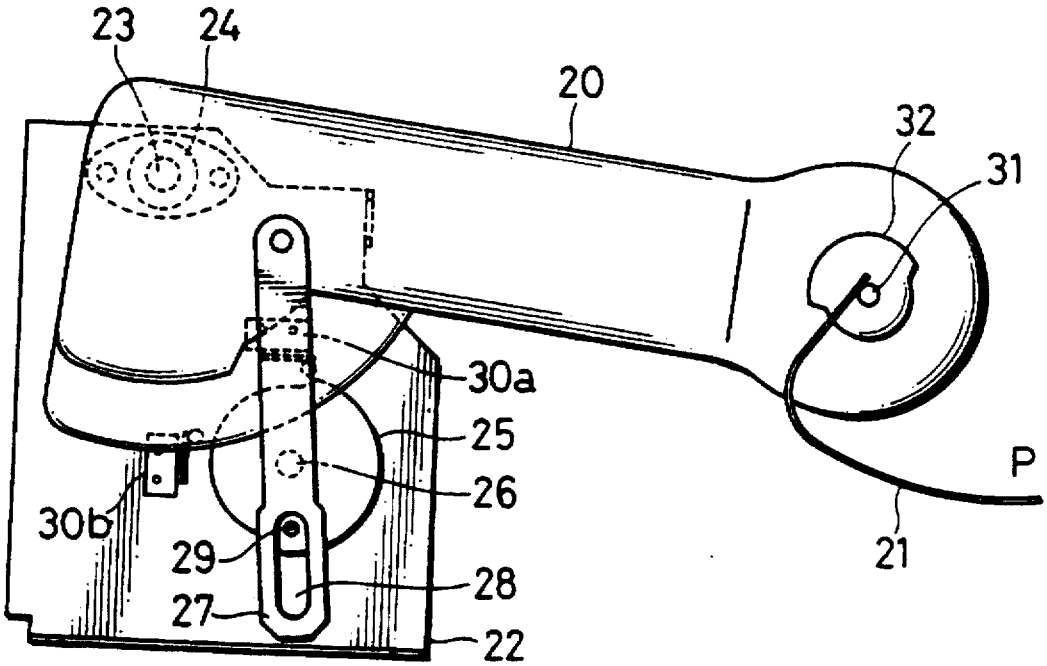
FIG. 5 is a schematic diagram illustrating a mechanism for swinging a prize pickup arm and a shovel.
Figure 6:
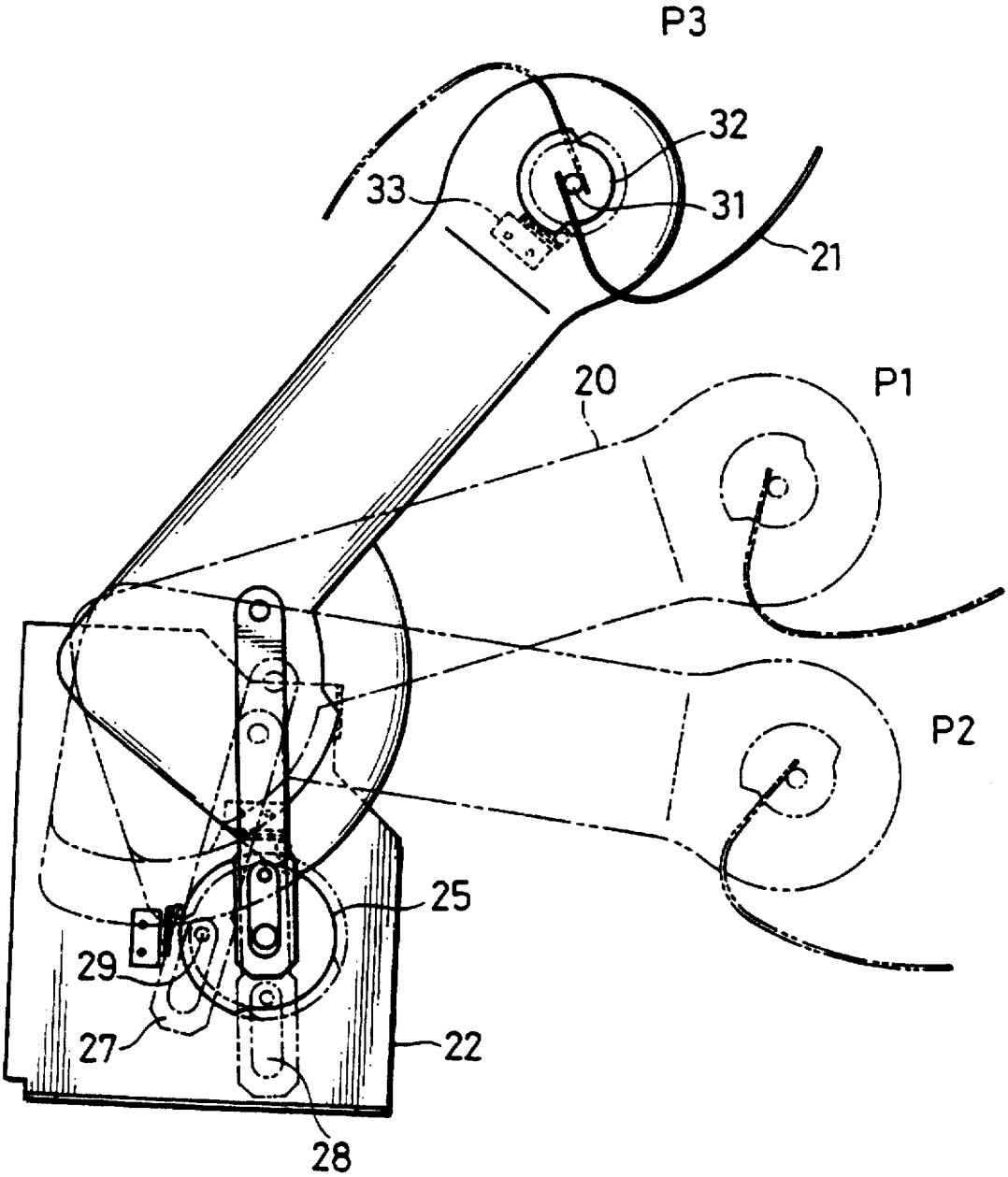
FIG. 6 is a schematic diagram illustrating swing positions of the prize pickup arm.

Referring now to FIGS. 5 and 6, a mechanism for swinging and turning the arm 20 and shovel 21 provided at each player's position is described below.

Designated by the numeral 22 is a supporting bracket attached to the main mechanical block 7. A swing pivot 23 fixed to a supporting end of the arm 20 is rotatably fitted into a bearing 24 which is fixed to the supporting bracket 22. Designated by the numeral 25 is a crank, which also serves as a circular disc cam, connected to an unillustrated turning mechanism (such as a drive shaft 26 of a motor, for example), and designated by the numeral 27 is a link. As shown in FIG. 5, one end of the link 27 is connected to the arm 20 close to its supporting end by a pin. A slot 28 is formed in the other end of the link 27 and a follower pin 29 projecting from the outside surface of the crank 25 is slidably fitted into the slot 28.

When the crank 25 is caused to rotate by the unillustrated turning mechanism, the arm 20 swings about its swing pivot 23 by an angle determined by the mounting position of the follower pin 29 and the length of the link 27 as shown in FIG. 6. Even if a collision occurs between the arm 20 and any prize item or nearby mechanical part of the game machine, causing an upward turning force acting on the arm 20, the arm 20 is not subjected to too high a stress because it is swingable upward as much as the length of the slot 28.

In this embodiment, each arm 20 is made controllably stoppable at three positions shown in FIG. 6. These positions include a standby position designated by P1, a prize scooping position (also referred to as a third position) designated by P2 where the shovel 21 is located immediately above the vessel 5, and a prize dropping position (also referred to as a fourth position) designated by P3 where the shovel 21 is located just above the relevant tongue-shaped plate element 9.

There are mounted two micro switches 30*a* and 30*b* on the supporting bracket 22 of each arm 20 beside the crank 25 for sensing the aforementioned three positions of the arm 20. The periphery of the crank 25 is shaped in the form of a circular disc cam which causes the micro switches 30*a* and 30*b* to make or break as appropriate, enabling them to sense the three positions of the arm 20. More particularly, when the arm 20 swings from its standby position P1 to prize scooping position P2, the peripheral surface of the crank 25 is separated from the micro switch 30*a* so that it becomes off. When the arm 20 swings from its standby position P1 to prize dropping position P3, the peripheral surface of the crank 25 comes into contact with the micro switch 30*a* so that it becomes on. Also, when the arm 20 swings from the prize scooping position P2 or prize dropping position P3 to the standby position P1, the other micro switch 30*b* becomes on or off. It is possible to detect the three positions of the arm 20 based on on/off states of the micro switches 30*a* and 30*b* in this embodiment.

In FIG. 5, designated by the numeral 31 is a pivot fitted to the free end of the arm 20 and connected to an unillustrated turning mechanism (such as a drive shaft of a motor, for example). Mounted on this pivot 31, the shovel 21 is controlled to stop at a specified position designated by P in FIG. 5 after making a single turn as will be further discussed later. For sensing the position of the shovel 21, there are provided a circular disc cam 32 securely fixed on the pivot 31 and a limit switch 33 (shown in FIG. 6) which becomes on or off when the shovel 21 approaches or leaves the position P, depending on whether the peripheral surface of the circular disc cam 32 is in or out of contact with the limit switch 33.

Each shovel 21 ( also referred to as a prize catching member) has a larger width than the tongue-shaped plate elements 9 as shown in FIG. 3. Accordingly, each player can scoop up a relatively large number of prize items. This creates a kind of visual effect which gives the players a sense of satisfaction in playing prize capturing games. It is to be noted, however, that even when a player succeeds in scooping a relatively large number of prize items and dropping them with proper timing, they do not necessarily remain on the tongue-shaped plate element 9 at the player's position. In other words, some of the prize items may fall out of the tongue-shaped plate element 9 so that the number of prizes one player finally acquires usually becomes smaller than the number of prizes the player has successfully scooped by manipulating the relevant shovel 21. This will make the prize capturing game more interesting and enjoyable, enabling the players to find enthusiasm for acquiring more prizes.

If the moving direction of a shovel 21, or the direction of swing of its arm 20, is made approximately same as the reciprocating direction of a corresponding tongue-shaped plate element 9 as seen in the foregoing description of this embodiment, a large portion of the movable range of the shovel 21 overlaps with that of the tongue-shaped plate element 9. According to this arrangement of the embodiment, it is not necessary to secure a large moving space for each shovel 21 even when its width is made larger than that of the tongue-shaped plate elements 9. The arrangement is beneficial to space-saving purposes as will be understood more particularly from the following discussion.

In the previously-mentioned prize catching game machine of the prior art, the moving direction of the transfer table intersects that of the shovel approximately at right angles to each other and, therefore, there is created only a small overlap of movable ranges of the shovel and the transfer table. In such a configuration, if the shovel is widened to make it possible to scoop a large number of prize items at a time, the prize catching game machine inevitably becomes large due to the need for securing sufficient strokes of the shovel and the transfer table. Contrary to this, the embodiment of the invention provides a considerable overlap between the movable ranges of each shovel 21 and tongue-shaped plate element 9. The prize catching game machine of the embodiment need not be made so large for securing moving strokes of the shovels 21, as compared to the prize catching game machine of the prior art, even when the individual shovels 21 are relatively wide.

Referring once again to FIGS. 1 to 4, designated by the numeral 40 are prize delivery ports provided in the main body 1 of the prize catching game machine beneath the individual operating consoles 2. There is formed an opening under each hole 8 in the main mechanical block 7 and each hole 8 is connected to its corresponding prize delivery port 40 by a cavity 41 formed in the main mechanical block 7 and a slope 42 connecting the cavity 41 and prize delivery port 40. Designated by the numerals 43, 44 and 45 in FIGS. 1 and 2 are a coin slot, a coin return lever and a coin return, respectively, provided at each player's position. Further, designated by the numeral 46 is a transparent cover having a generally quadrilateral pyramid shape for covering the top of the display area 4. One side of the base of the transparent cover 46 is connected to the main body 1 of the prize catching game machine by hinges 47 as shown in FIG. 3. It is therefore possible to swing up the transparent cover 46 about the hinges 47 to expose the display area 4 when replenishing the vessel 5 with prize items.

Operation of the prize catching game machine of the foregoing embodiment is now described with reference to FIGS. 1 to 7.

When a power switch (not shown) of the main body 1 of the prize catching game machine is turned on with prize items placed in the vessel 5, the vessel 5 is caused to rotate in one direction by the earlier-mentioned turning mechanism (not shown). A prize capturing game is commenced when a player inserts a coin into one of the coin slots 43 in this condition.

Until the player presses the button 3*a* or 3*b*, the arm 20 at the player's position is held at its standby position P1 (FIG. 6). The player would press the button 3*a* when he or she judges that a desired prize has come to an appropriate position. When the button 3*a* is pressed, the earlier-mentioned turning mechanism (not shown) causes the arm 20 to swing to its prize scooping position P2 and the shovel 21 descends down to a position immediately above the vessel 5. The shovel 21 is caused at the same time to make a single counterclockwise rotation (as illustrated in FIGS. 5 and 6) by its turning mechanism (not shown) so that an edge of the shovel 21 moves along the curved inner surface of the vessel 5. If the shovel 21 rotates with proper timing, it will scoop up the desired prize. The arm 20 is then swung to its prize dropping position P3 by its turning mechanism and the shovel 21 ascends up to a position immediately above the relevant tongue-shaped plate element 9.

The player would press the button 3*b* when he or she judges that the tongue-shaped plate element 9 which projects from and retracts into one of the holes 8 in the main mechanical block 7 has come to an appropriate position. When the button 3*b* is pressed, the shovel 21 is caused to make a single counterclockwise rotation (as illustrated in FIGS. 5 and 6) by its turning mechanism. As a result, the prize which has been scooped by the shovel 21 drops onto the tongue-shaped plate element 9 provided that the player has pressed the button 3*b* with proper timing. The prize successfully dropped on the tongue-shaped plate element 9 is taken into the hole 8, goes into contact with a rear surface 80 of the hole 8 and falls down when the tongue-shaped plate element 9 is fully retracted into the main mechanical block 7. The prize which has fallen from the tongue-shaped plate element 9 is automatically delivered to the relevant prize delivery port 40 through the cavity 41 and slope 42, allowing the player to take it out of the game machine. The arm 20 is then swung back to its standby position P1 by the turning mechanism and remains.

As is apparent from the foregoing discussion, the prize catching game machine of the embodiment enables the player to acquire a desired prize if he or she successfully drops it on the tongue-shaped plate element 9. The embodiment makes it more certain that a player can acquire the desired prize should the player succeed in carrying out a two-step sequence of scooping and dropping the desired prize. This means that the invention makes prize capturing games more interesting and attractive compared to prior art technology.

It is to be understood that the invention is not limited in its application to the preferred embodiment which has thus far been described. Although the prize catching game machine of the preferred embodiment is constructed to allow four players to play together a prize capturing game, it may be modified to accommodate more than, or less than, four players at the same time by increasing or decreasing the number of operating consoles 2, prize catching devices including arms 20 and shovels 21, and so on. Although each operating console 2 is provided with two buttons 3*a* and 3*b* for entering commands for scooping and dropping prizes in the foregoing embodiment, modification may be made so that the prize scooping and dropping sequence are executed successively by pressing a single button, for example.

While the invention has been illustrated with respect to several specific embodiments thereof, these embodiments should be considered as illustrative rather than limiting. Various modifications and additions may be made and will be apparent to those skilled in the art without departing from the spirit and scope of the present invention. Accordingly, the invention should not be limited by the foregoing description but rather should be defined only by the following claims.

What is claimed is:

1. A prize catching game machine comprising:

a table;

a prize catcher for catching a prize carried on the table and transferring the prize which has been caught to a predetermined position and releasing the prize at the predetermined position;

a prize receiver movable between a first position and a second position, said prize receiver having at least one receiving position between said first and second positions, said at least one receiving position underlying said prize catcher when said prize catcher is in said predetermined position such that release of the caught prize in said prize catcher when said prize catcher is in said predetermined position and said prize receiver is in said at least one receiving position effects transfer of said prize from said prize catcher to said prize receiver, said prize catcher including a prize catching member which has a larger width than that of the prize receiver.

2. A prize catching game machine as defined in claim 1, wherein the prize catching member is a shovel like member which can scoop the prize carried on the table.

3. A prize catching game machine comprising:

a table;

a prize catcher for catching a prize carried on the table and transferring the prize which has been caught to a predetermined position and releasing the prize at the predetermined position;

a prize receiver movable between at least one first position and at least one second position, said prize receiver when at said at least one first position underlying said prize catcher when said prize catcher is in said predetermined position and being capable of receiving the prize released from the prize catcher, said prize receiver when at said at least one second position being displaced from underlying said prize catcher when said prize catcher is in said predetermined position and being incapable of receiving the prize released from the prize catcher.

4. A prize catching game machine comprising:

a table;

a prize catcher for catching a prize carried on the table and transferring the prize which has been caught to a predetermined position and releasing the prize at the predetermined position; and a prize receiver movable between a first position and a second position, said prize receiver having at least one receiving position between said first and second positions, said at least one receiving position underlying said prize catcher when said prize catcher is in said predetermined position such that release of the caught prize in said prize catcher when said prize catcher is in said predetermined position and said prize receiver is in said at least one receiving position effects transfer of said prize from said prize catcher to said prize receiver;

a prize delivery port enabling access to the prize from outside of the game machine;

said prize receiver being constructed such that the prize on the prize receiver is transmitted to the prize delivery port when said prize receiver is moved to said first position.

5. A prize catching game machine comprising:

a table;

a prize catcher for catching a prize carried on the table and transferring the prize which has been caught to a predetermined position and releasing the prize at the predetermined position;

a prize receiver movable between a first position and a second position, said prize receiver having at least one receiving position between said first and second positions, said at least one receiving position underlying said prize catcher when said prize catcher is in said predetermined position such that release of the caught prize in said prize catcher when said prize catcher is in said predetermined position and said prize receiver is in said at least one receiving position effects transfer of said prize from said prize catcher to said prize receiver; and a prize discharging device for forwarding the prize on the prize receiver to a prize delivery port for enabling access to the prize from outside of the game machine, said prize discharging device forwarding the prize on the prize receiver to the prize delivery port as said prize receiver moves to said first position.

6. A prize catching game machine comprising:

a table;

a prize catcher for catching a prize carried on the table and transferring the prize which has been caught to a predetermined position and releasing the prize at the predetermined position;

a prize receiver movable between a plurality of positions, said prize receiver having at least one non-receiving position, said prize receiver when at said at least one non-receiving position being displaced from underlying said prize catcher when said prize catcher is in said predetermined position such that said prize receiver is incapable of receiving a prize released from said prize catcher.

7. A prize catching game machine comprising:

a table;

a prize catcher for catching a prize carried on the table and transferring the prize which has been caught to a predetermined position and releasing the prize at the predetermined position;

a prize receiver movable between a plurality of positions, said prize receiver having at least one receiving position underlying said prize catcher when said prize catcher is in said predetermined position such that release of the caught prize in said prize catcher when said prize catcher is in said predetermined position and said prize receiver is in said at least one receiving position effects transfer of said prize from said prize catcher to said prize receiver, said prize receiver having at least one non-receiving position displaced from said at least one receiving position, said at least one non-receiving position being displaced from underlying said prize catcher such that said prize is incapable of being transferred from said prize catcher to said prize receiver when said prize catcher is in said predetermined position and said prize receiver is in said at least one non-receiving position.

8. A prize catching game machine comprising:

a table;

a prize catcher for catching a prize carried on the table and transferring the prize which has been caught to a predetermined position and releasing the prize at the position;

a prize receiver movable between a first position and a second position for changing a receiving area to receive the released prize and, from the top view, the predetermined position of the prize is enclosed in the receiving area of the prize receiver at least at one point between the first and second positions, a direction of movement of the prize catcher in plan view being substantially parallel to a direction of movement of the prize receiver in plan view.

9. A prize catching game machine as defined in claim 8, wherein the prize catcher includes an arm which is rotatable with respect to a horizontal axis extending through one end thereof and a shovel which is rotatably mounted on the other end of the arm.

* * * * *